US006488088B1

(12) United States Patent
Kohli et al.

(10) Patent No.: US 6,488,088 B1
(45) Date of Patent: Dec. 3, 2002

(54) MIXING AND PUMPING VEHICLE

(75) Inventors: Harjit S. Kohli, Sugar Land, TX (US); Elizabeth A. Mackenzie, Gloucester (CA); Gary L. Rogers, Sugar Land, TX (US); Jean-Louis Pessin, Houston, TX (US); Erik Rhein-Knudsen, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 60 days.

(21) Appl. No.: 09/607,089

(22) Filed: Jun. 29, 2000

(51) Int. Cl.[7] ..... E21B 03/13; B01E 13/00

(52) U.S. Cl. ..... 166/285; 366/138; 366/142; 366/342

(58) Field of Search ..... 166/285; 366/1, 366/138, 142, 341, 336

(56) References Cited

U.S. PATENT DOCUMENTS

| | | | | |
|---|---|---|---|---|
| 1,982,817 A | | 12/1934 | Leach et al. | |
| 3,091,438 A | | 5/1963 | Hembree | |
| 4,097,925 A | * | 6/1978 | Butler | 366/2 |
| 4,199,262 A | | 4/1980 | Cribb et al. | |
| 4,298,288 A | | 11/1981 | Weisbrod | |
| 4,311,396 A | | 1/1982 | Brandi | |
| 4,802,141 A | | 1/1989 | Stegemoeller et al. | |
| 4,913,554 A | | 4/1990 | Bragg et al. | |
| 5,103,908 A | | 4/1992 | Allen | |
| 5,213,414 A | | 5/1993 | Richard et al. | |
| 5,289,877 A | | 3/1994 | Naegele et al. | |
| 5,460,301 A | | 10/1995 | Ebinger et al. | |
| 5,496,111 A | | 3/1996 | Laverne | |
| 5,775,803 A | | 7/1998 | Montgomery et al. | |
| 5,803,596 A | | 9/1998 | Stephens | |

OTHER PUBLICATIONS

Schlumberger, "CPT–372 Double–Pump Cement Truck," pp. 1–3 (Jul. 31, 1997).
Schlumberger, "CCT–172 Combination Pump Truck," pp. 1–3 (Jul. 31, 1997).

* cited by examiner

*Primary Examiner*—David Bagnell
*Assistant Examiner*—Jennifer R. Dougherty
(74) *Attorney, Agent, or Firm*—Stephen Schlather; Catherine Menes

(57) ABSTRACT

A vehicle, such as a truck, includes mixing and pumping equipment for mixing a liquid and a particulate material (e.g., cement) and for pumping the mixture. One application is to pump the mixture into a wellbore for cementing a casing or liner to the wellbore inner wall. The vehicle includes a cab, with the mixing and pumping equipment positioned behind the cab. The equipment includes one or more reservoirs, with at least one used as both a mixing and displacement tank. A hose assembly is also positioned on the vehicle. To reduce the weight load placed on the rear axle(s) of the vehicle, relatively heavy components, such as the pump, are placed further forward on the truck. In one arrangement, the pump may be placed between the cab and the one or more reservoirs.

10 Claims, 5 Drawing Sheets

MIXING AND PUMPING VEHICLE

BACKGROUND

The invention relates to fluid pumping vehicles, such as vehicles for pumping cement slurry.

Many activities may be performed in a well during the drilling, completion, and production phases of well operation. For example, when placing casing or a liner in a wellbore, the casing or liner is typically cemented to the inner wall of the wellbore. The cement is mixed at the surface and pumped into the wellbore as cement slurry. The cement slurry is flowed into the annular region between the outside of the casing or liner and the inner wall of the wellbore.

The cement slurry is typically mixed at the well surface by a truck carrying the cement mixer equipment. The cement slurry is a mixture of water, cement powder, and additives, which are mixed by the cement mixer. The truck typically also contains a pump to pump the cement slurry into the well through a tubing. Trucks are used to carry the cement mixing and pumping equipment to provide mobility to various well sites that need their services. In many instances, the well sites are located in remote regions that may be difficult to reach.

Conventional cement mixing and pumping equipment are relatively heavy, and include hydraulic pumps, displacement tanks, and various other equipment. To carry the heavy equipment, relatively large trucks may be used. Such trucks may have multiple (e.g., two) rear axles to handle the load of the heavy equipment. Due to the heavy load and the size of the trucks, it may be difficult to drive the trucks to some well sites in hard-to-reach locations. In addition, government regulations may place weight limits on trucks. For example, a limit may be set on the load that may be placed on the rear axle(s) of the truck, particularly during some months of the year. With many conventional cement mixing and pumping trucks, the weight load is concentrated on the rear axle(s), which may violate government regulations for some roads.

Conventionally, to deliver cement slurry from the cement mixing and pumping truck to wellhead equipment, high-pressure metal (e.g., steel) tubing (sometimes referred to as treating iron) is used. The tubing is typically made up of several segments, with the segments carried by the cement mixing and pumping truck. Attachment of the segments is performed at the well site. However, the tubing segments are typically heavy and may be unwieldy. In addition, the tubing is inflexible, which requires use of special equipment to enable vertical movement of wellbore components such as casing. Making up the tubing and the associated equipment is a time consuming process. In addition, having to transport the heavy tubing segments and associated equipment adds to the overall weight of the truck.

A need thus exists for a method and apparatus to overcome limitations of conventional systems used for conveying cement slurry and other types of fluids into a wellbore.

SUMMARY

In general, according to one embodiment, a vehicle comprises a cab, at least one reservoir, and at least one pump positioned between the at least one reservoir and the cab. The vehicle also comprises a hose assembly through which fluid from the reservoir may be pumped.

Other features and embodiments will become apparent from the following description, from the drawings, and from the claims.

DETAILED DESCRIPTION

Figure 1:
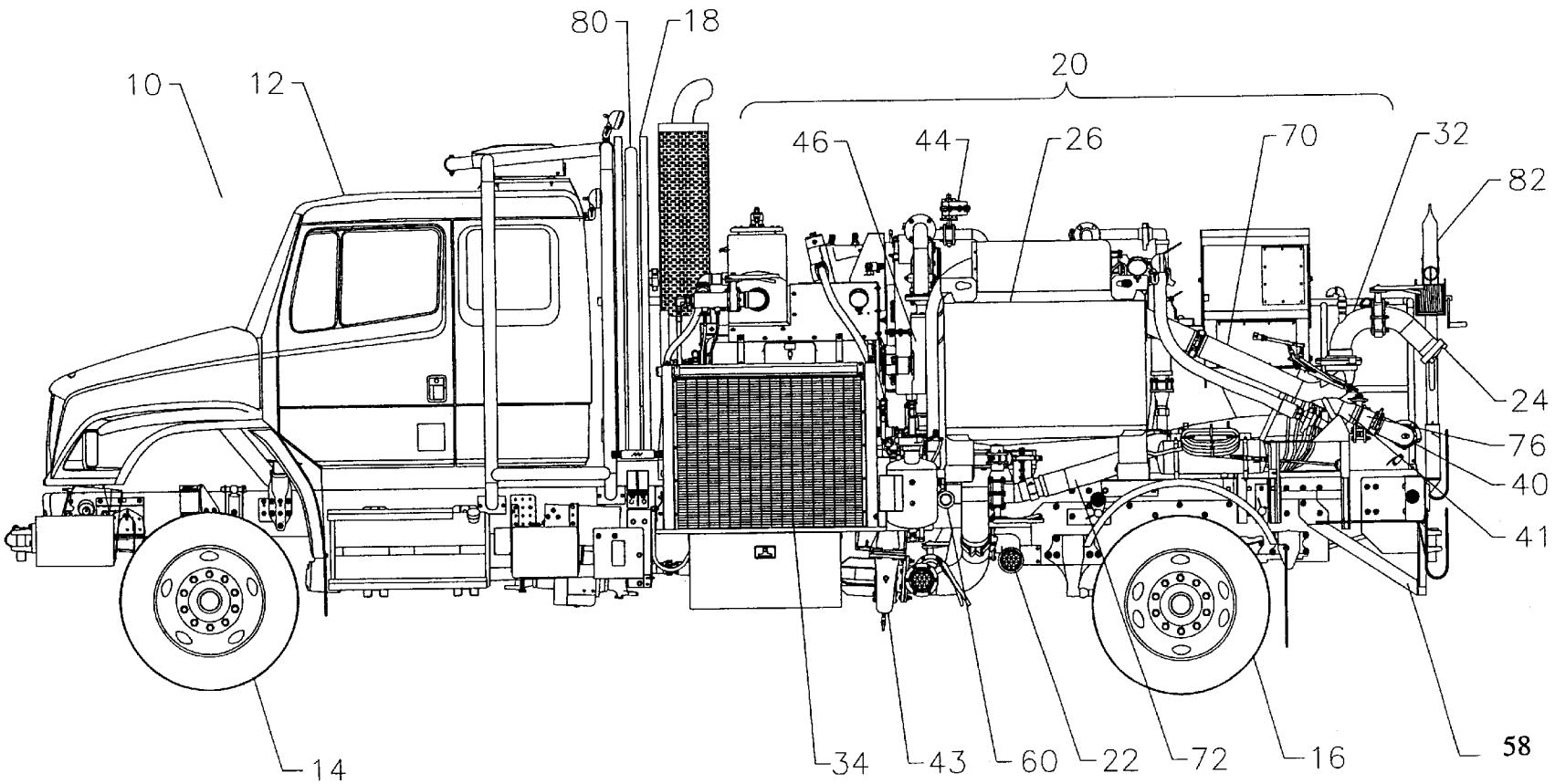
FIG. 1 is a side view of the right side of a truck carrying mixing and pumping equipment in accordance with an embodiment.

In the following description, numerous details are set forth to provide an understanding of the present invention. However, it will be understood by those skilled in the art that the present invention may be practiced without these details and that numerous variations or modifications from the described embodiments may be possible.

Referring to FIGS. 1–4, a truck 10 (or some other type of vehicle) includes a cab 12 in which an operator of the truck may sit. The cab 12 and various equipment are positioned on a platform that sits on wheels 14 and 16. In the illustrated embodiment, the rear wheels 16 are connected to a single axle. In further embodiments, the truck 10 may have multiple rear axles.

The equipment that is carried by the truck 10 in one embodiment includes cement mixing and pumping equipment 20 and a reel and hose assembly 18. The cement mixing and pumping equipment 20 has several inlets 22, 60, and 62 (FIGS. 1 and 3), for receiving a liquid, such as water. The cement mixing and pumping equipment 20 also has a second inlet 24 (FIG. 1), near the rear of the truck 10 for receiving a particulate material, such as cement in powder form. Although reference is made to cement mixing equipment in accordance with one embodiment, further embodiments may include equipment for mixing other types of particulate materials.

Figure 2:
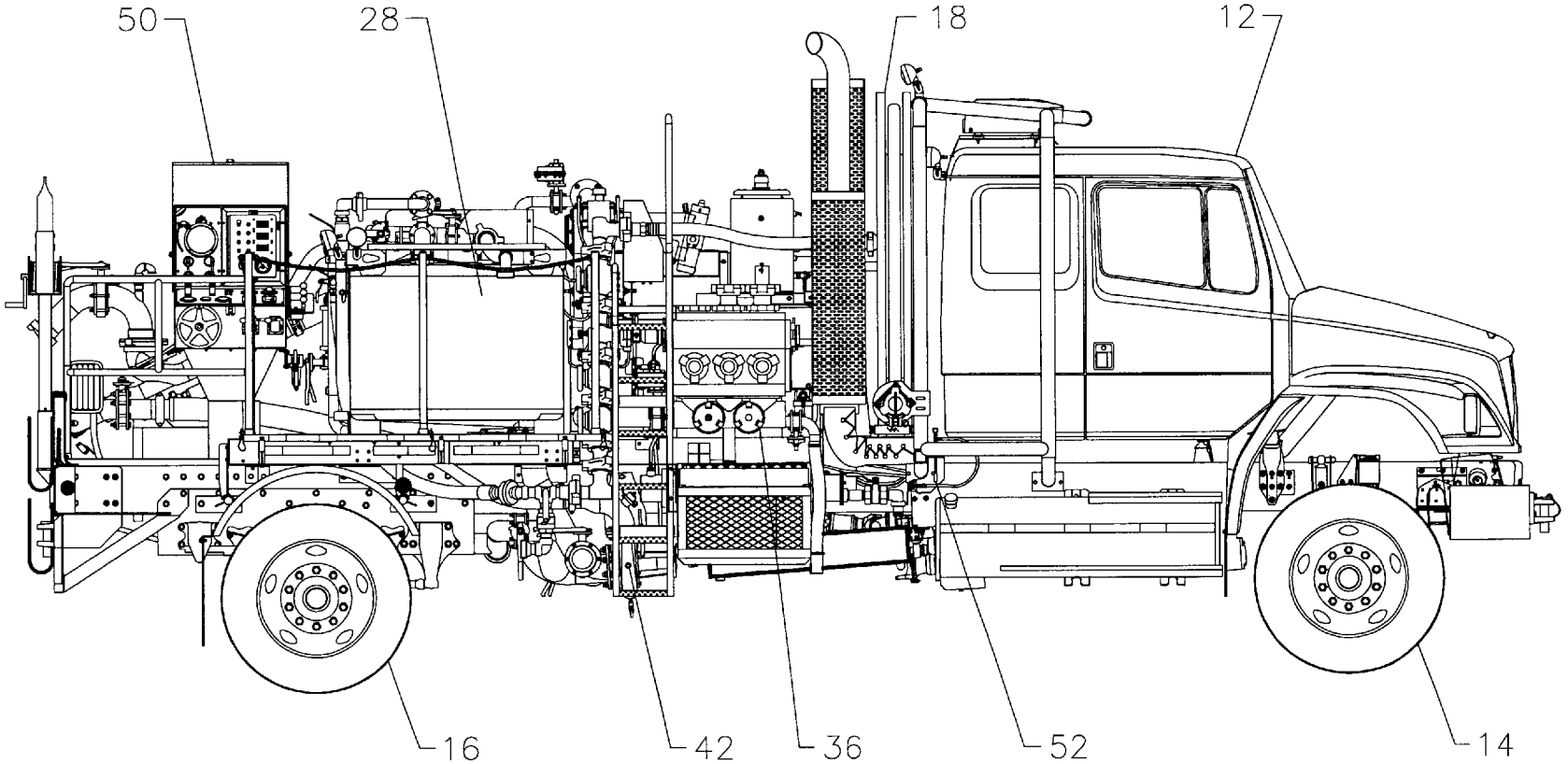
FIG. 2 is a side view of a left side of the truck of FIG. 1.
Figure 3:
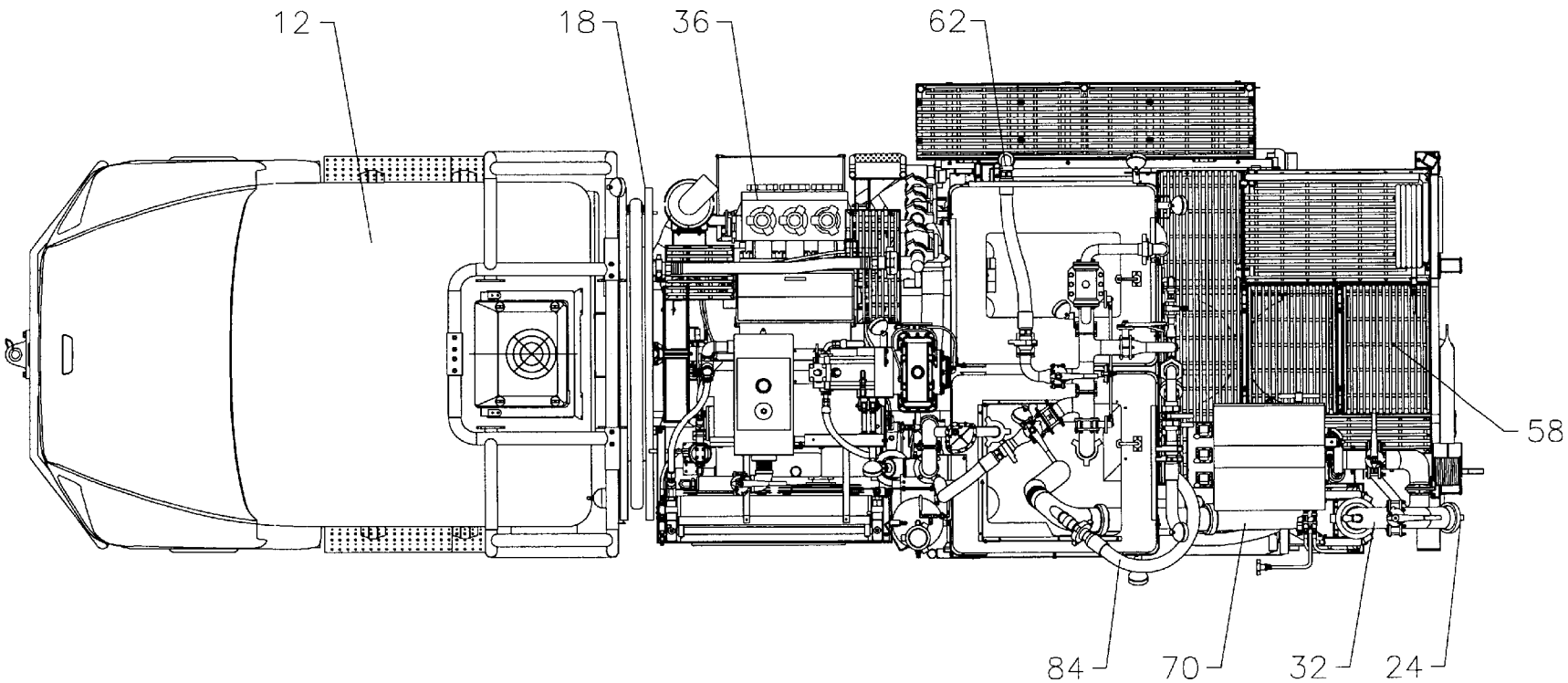
FIG. 3 is a top view of the truck of FIGS. 1 and 2.

In one embodiment, the equipment 20 further includes two reservoirs 26 (FIG. 1) and 28 (FIG. 2). Conduits lead from the water inlets 22, 60, and 62 to the reservoirs 26 and 28 and to the cement mixer 40, while a conduit 32 carries cement from the cement inlet 24 to a cement mixer 40 that injects a cement, water, and additive mixture into the reservoir 26. Both reservoirs 26 and 28 are used as displacement tanks. In addition, in accordance with some embodiments, the first reservoir 26 is also used as a mixing tank to mix cement, water, and additive to form the cement slurry that can be pumped into the wellbore. In another embodiment, both reservoirs 26 and 28 may be used as combined displacement and mixing tanks. By combining the functions of a mixing tank and a displacement tank in one reservoir, the number of reservoirs that need to be placed on the truck 10 can be reduced, thereby reducing the overall size and weight of the truck. Furthermore, another benefit is that a separate cleanup step of the cement mix tank is made unnecessary as the displacement process also cleans the mix tank.

The truck 10 includes two centrifugal pumps 43 (FIG. 1) and 42 (FIG. 2). The centrifugal pumps 43 and 42 enable low pressure mixing as well as taking of water from the water inlets 22, 60, and 62. When the centrifugal pumps are activated, the mixture of water and cement is flowed through a cement mixer 40, such as a Slurry Chief Mark II cement mixer from Schlumberger, in one embodiment. The cement received from the cement inlet 24 through the conduit 32 and the water received from one of inlets 22, 60, and 62 are flowed into a propulsion device 41 in the cement mixer 40 that propels the mixture of water and cement as a jet through a pipe 70 into the mixing tank. The water is received at the propulsion device 41 from a conduit 85 (FIG. 4), which is connected to a Y-shaped branch connector 86. The Y-shaped branch connector 86 has one inlet and first and second outlets. The first outlet is connected to the conduit 85, and the second outlet is connected to another conduit (discussed further below). The inlet of the branch connector 86 is connected to a valve 67, which receives water from a conduit 68 that is in communication with one of the water inlets 22, 60, and 62. The flow of the water is controlled by the centrifugal pump 42 (FIG. 2), which in one embodiment is a 4×5 centrifugal pump. The water flowing through the conduit 85 flows to the propulsion device 41.

Figure 4:
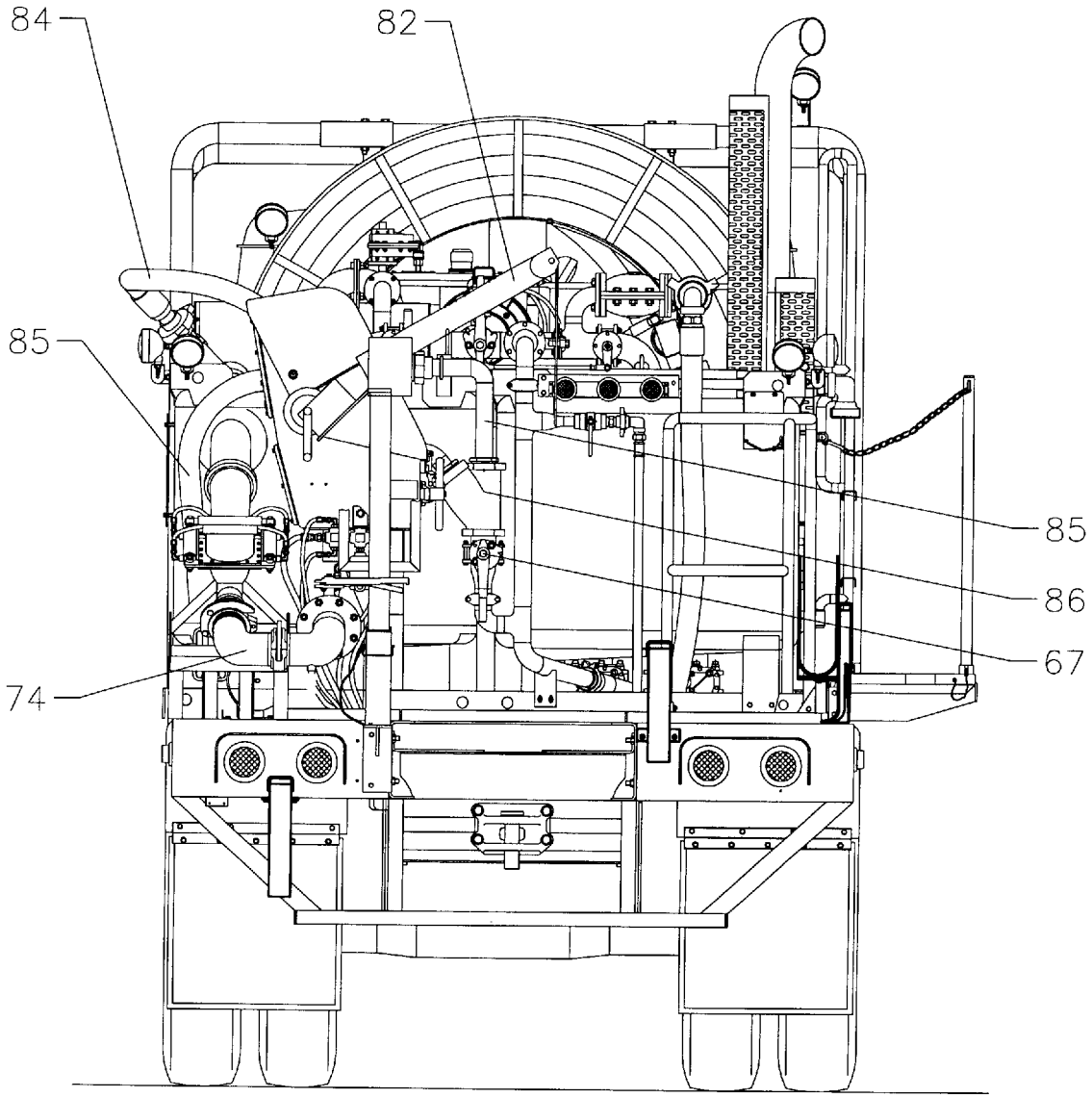
FIG. 4 is a rear view of the truck of FIGS. 1–3.

The other centrifugal pump 43, which in one embodiment is a 5×6 centrifugal pump, controls the circulation of the cement and water mixture from the mixing tank 26 back through the cement mixer 40. The centrifugal pump 43 pumps the mixture of cement and water out of the mixing tank 26 and through a pipe 72 (FIG. 1) that leads to a U-shaped conduit 74 (FIG. 4). The mixture of cement and water is pumped through the U-shaped conduit 74 to a pipe 76 (FIG. 1) and leads into the propulsion device 41. If the cement inlet 24 and the water inlets are still taking water, the cement and water mixture in pipe 76 is further mixed with the incoming water and cement and propelled through the pipe 70 by the propulsion device 76 back to the mixing tank 26.

The cement and water mixture is also flowed through a flow meter 46, which also contains a densitometer. The densitometer measures the density of the cement and water mixture. This enables the operator to monitor the density of the cement and water mixture to determine if the mixture is ready to be pumped into the well. A valve 44, when open, allows the flow of cement slurry back into the mixing tank 26. This allows an accurate measure of the density of the cement slurry when not pumping downhole.

Water may also be flowed into a conduit 84 (FIGS. 3 and 4) that leads into the mixing tank 26. Flow into the conduit 84 is controlled by a valve (not shown) that is connected to the second outlet of the Y-shaped branch connector 86. To adjust the density of the cement and water mixture, the valve leading into the conduit 84 may be opened to enable more water to be flowed into the mixing tank 26.

In one embodiment, the equipment 20 further includes a triplex pump 36 (FIGS. 2 and 3) that is hydraulically powered. The triplex pump 36 provides the power to pump the cement slurry through a hose 80 of the reel and hose assembly 18. A hydraulic cooler 34 (FIG. 1) cools the hydraulic fluid used for powering the triplex pump 36 and other hydraulically driven components.

The hydraulically driven triplex pump 36 allows convenient control of cement slurry flow rates and pressures and, in one embodiment, is capable of delivering up to about 170 hydraulic horsepower. Also, in one example embodiment, a maximum flow rate of approximately 7 barrels per minute (bpm) and a maximum pressure of approximately 3,000 pounds per square inch (psi) may be achieved. In other embodiments, triplex pumps with higher or lower horsepower, flow rate and pressure ratings may be used. In addition, the triplex pump 36 may be replaced with another type of pump.

The hose 80 of the reel and hose assembly 18 is a flexible hose that, in one embodiment, may be made of a rubber and metal composite. For example, the hose 80 may be Coal-Master hose from Dayco Industrial Products Inc. Other hoses made of similar lightweight material may be employed in further embodiments. The hose 80 is substantially lighter than conventional metal tubings (sometimes referred to as treating irons) used to carry cement slurry into a wellbore in some conventional systems. The conventional metal tubing is typically made of steel, and may be heavy and unwieldy. In contrast, the hose 80 is relatively light and it can be carried on the truck 10. The hose 80 can also be quickly unreeled from the truck 10 and connected to wellhead equipment for operation. Also, by use of a relatively lightweight hose assembly, the overall weight of the truck can be reduced when compared to conventional systems in which heavy metal tubing is employed.

The truck 10 also includes an operator console 50 located proximal the back of the truck 10. From the operator console 50, an operator can control the mixing as well as pumping operations by activating pumps and actuating appropriate valves, including the valve 44 (FIG. 1). The operator console 50 can also be used to monitor the density of the cement slurry during mixing. In addition, flow rates may be monitored, as well as the volume of cement slurry or displacement fluid flowed from the reservoirs 26 and 28 into the wellbore. The flow rate is monitored by the flow meter 46, which provides an accurate measure of the flow rate of cement slurry and displacement fluid. The flow meter 46 provides an accurate measure of flow rate even if the discharge pressure into a wellbore is low.

A control unit 52 (FIG. 2), located underneath the cab 12 in accordance with one embodiment, controls operation of the reel and hose assembly 18. The control unit 52 activates a motor to rotate the mechanized reel and hose assembly 18 in a clockwise or counterclockwise direction to unreel or load the hose 80.

The truck 10 also includes a storage bin 58 (FIG. 3), for storing a cement head (not shown). A cement head is typically loaded with one or more plugs that can be launched into a wellbore during cement slurry pumping operations. By using the storage bin 58 to carry the cement head, a separate transport vehicle is not needed for the cement head. A crane 82 may also be located near the rear of the truck 10 to load and unload the cement head to or from the storage bin 58.

Figure 5:
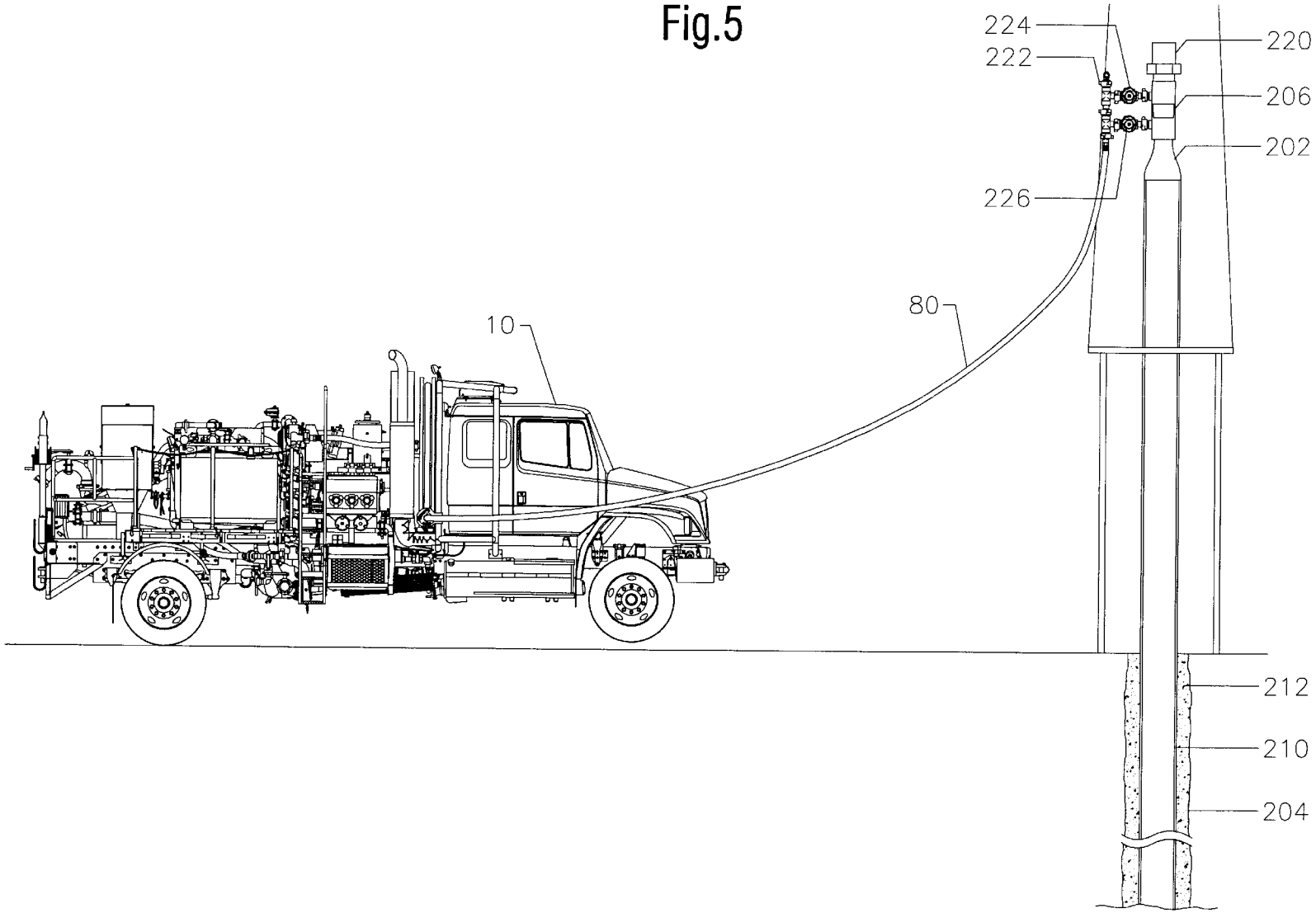
FIG. 5 illustrates the truck used with well equipment in accordance with an embodiment.

Referring to FIG. 5, operation of the equipment on the truck 10 is discussed. The truck 10 is driven to and parked at a well site 200. The cement head 220 and manifold 222 are unloaded from the storage bin 58 using the crane 82, transported to the rig floor, and made up to the top of the wellhead equipment 202. The control unit 52 is then activated to unreel the hose 80 from the reel and hose assembly 18, and the hose 80 is connected to the manifold 222. A source of cement is coupled to the cement inlet 24, and a source of water is coupled to one or more of the water inlets 22, 60, and 62. Cement in powder form is provided through the cement inlet 24, and water is provided through one or more of the water inlets 22, 60, and 62. The water and cement are mixed by the cement mixer 40 and flowed through the mixing tank 26 when the centrifugal pumps 42 and 43 are activated by an operator at the console 50 to start the mixing operation. The operator also opens the valve 44 to enable monitoring of the cement slurry density.

The triplex pump 36 is activated to pump cement slurry through the hose 80 to the cement head 220 and manifold 222. The valve 226 is opened to enable cement slurry flow into the wellbore 204. After an appropriate amount of cement slurry has been pumped into the wellbore 204, the valve 226 can be closed and the valve 224 opened to enable flow of displacement fluid into the cement head 220. The pressure build up behind a plug 206 causes it to be launched from the cement head 220 into the wellbore 204. The wellbore 204 may be lined with a liner or casing 210, which needs to be cemented to the inner wall 212 of the wellbore 204.

The reservoirs 26 and 28 are filled with water (or another displacement fluid) for pumping into the wellbore 204 behind the cement plug 206. The triplex pump 36 pumps the water from the displacement tanks 26 and 28 one at a time into the wellbore 204. Water from one displacement tank can be pumped into the wellbore while the other displacement tank is being filled. This allows the operator to determine how much fluid has been pumped into the wellbore. For example, each tank may have a 6-barrel capacity. Alternatively, the flow meter 46 can be relied upon to determine how much displacement fluid has been pumped into the wellbore. In that case, only one displacement tank is needed.

The displacement fluid pushes the plug 206 and the cement slurry downward into the well. When the plug 206 reaches the bottom of the wellbore 204, the cement slurry has been displaced into the annulus region between the casing or liner 210 and the wellbore wall 212. The cement slurry flowed into the annulus region later hardens to cement the casing or liner 210 to the wellbore wall 212.

After the cementing operation is over, the cement head 220 and manifold 222 can be detached from the wellhead equipment 202 and loaded back into the storage bin 58 of the truck 10. The hose 80 may be reeled back onto the hose and reel assembly 18 by operating the control unit 52. The truck 10 can then be driven to another well site to perform cementing operations.

By employing embodiments of the invention, various benefits may be realized. A more lightweight portable mixing and pumping system is provided since a more compact system is used. This is advantageous where access to well sites is difficult for larger and heavier trucks. In addition, government regulations may prohibit use of vehicles with greater than a predetermined weight load on the rear axle(s) of the truck. Compactness is achieved by reducing the number of components and by using more lightweight components. Also, the weight load on the rear axle(s) of the truck is reduced by distributing the components so that the heavier equipment is located further to the front of the truck. Also, by using an automated reel and hose assembly located on the truck, a more convenient mechanism is provided for conveying the mixed cement slurry from the truck to the wellhead equipment.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. A vehicle comprising:

a cab;

at least one reservoir, wherein said reservoir is a cement mix displacement tank;

at least one pump positioned between the at least one reservoir and the cab; and a hose assembly through which fluid from the reservoir may be pumped.

2. The vehicle of claim 1, wherein the hose assembly comprises a reel and a hose mounted on the reel.

3. The vehicle of claim 2, wherein the reel is rotatable to load or unload the hose.

4. The vehicle of claim 3, wherein the reel is mechanized.

5. The vehicle of claim 1, wherein the hose assembly is positioned between the at least one reservoir and the cab.

6. The vehicle of claim 1, wherein the hose assembly is positioned between the at least one pump and the cab.

7. The vehicle of claim 1, wherein the pump comprises a triplex pump.

8. The vehicle of claim 1, further comprising a cement mixer cooperable with the cement mix tank to mix cement and water.

9. The vehicle of claim 1, further comprising a flow meter to monitor flow of fluid from the reservoir.

10. A method of operating a well, comprising the steps of:

providing a vehicle comprising a hose assembly, a pump, and a reservoir wherein said reservoir is a cement mix displacement tank;

attaching the hose assembly to wellhead equipment;

mixing a particulate material with a liquid in the reservoir; and pumping a mixture of the particulate material and the liquid into the reservoir.

* * * * *